United States Patent [19]

Michetti

[11] 4,019,005

[45] Apr. 19, 1977

[54] MULTI-POLE CIRCUIT BREAKER WITH BAFFLE SHIELD VENTING

[75] Inventor: Anthony B. Michetti, Warminster, Pa.

[73] Assignee: I-T-E Imperial Corporation, Spring House, Pa.

[22] Filed: Dec. 30, 1974

[21] Appl. No.: 537,261

[52] U.S. Cl. ..... 200/144 R; 200/147 R; 337/110; 200/306

[51] Int. Cl.[2] ..... H01H 9/30; H01H 33/02

[58] Field of Search ..... 200/144 R, 144 C, 147 R, 200/289, 306; 335/8, 201; 337/110, 280, 281, 282

[56] References Cited

UNITED STATES PATENTS

| | | | |
|---|---|---|---|
| 2,942,083 | 6/1960 | Walker et al. | 337/110 X |
| 3,043,939 | 7/1962 | Gryctko | 337/110 X |
| 3,555,224 | 1/1971 | Frind et al. | 200/147 X |
| 3,649,791 | 3/1972 | Kruckewitt | 200/144 R |
| 3,728,503 | 4/1973 | Clausing et al. | 200/144 R |
| 3,786,380 | 1/1974 | Harper | 335/201 X |
| 3,803,376 | 4/1974 | Gryctko | 200/144 R |

*Primary Examiner*—James R. Scott
*Attorney, Agent, or Firm*—Ostrolenk, Faber, Gerb & Soffen

[57] ABSTRACT

A baffle assembly covering a vent opening in a molded case circuit breaker housing is constructed of two identical platelike elements having integral face protrusions. These elements are stacked in face-to-face relationship with their protrusions in engagement to maintain a narrow space between the element faces. Edge notches are provided to orient the elements so that the perforations of one element are misaligned with respect to the perforations of the other element so that arcing gases do not flow in a straight path through the baffle assembly.

10 Claims, 7 Drawing Figures

FIG. 3.
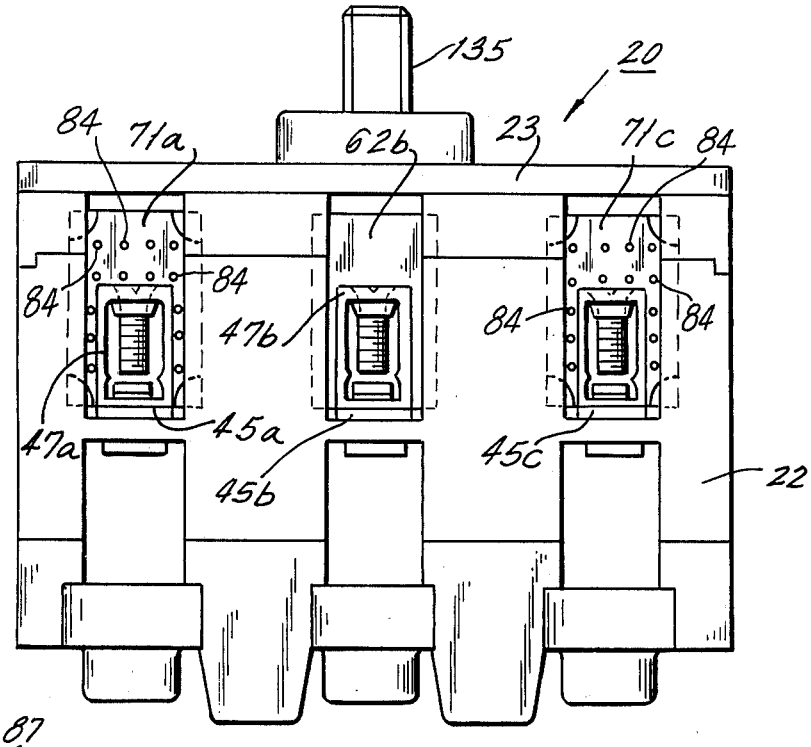
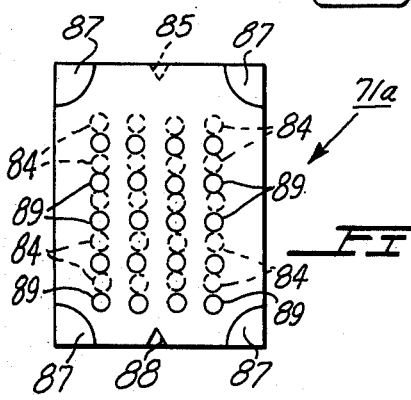
FIG. 5.
FIG. 7.
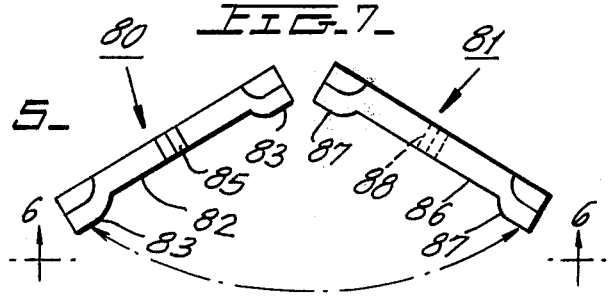
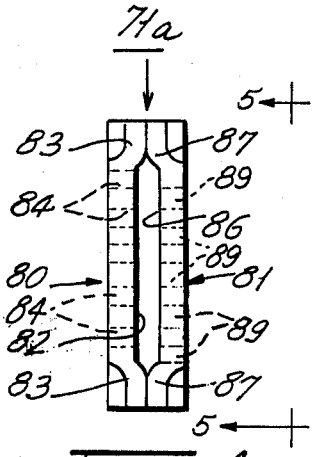
FIG. 4.
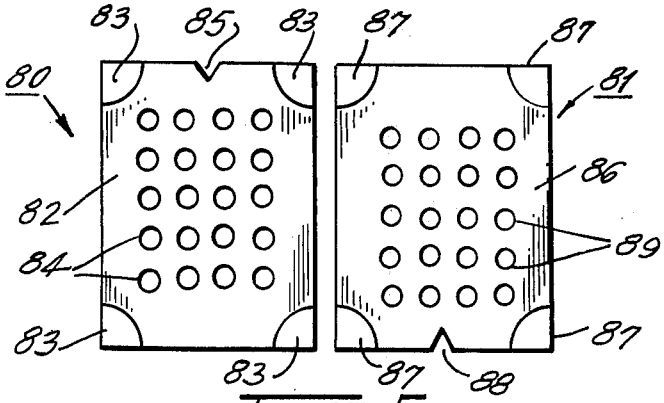
FIG. 6.

MULTI-POLE CIRCUIT BREAKER WITH BAFFLE SHIELD VENTING

This invention relates to molded case circuit breakers in general and more particularly relates to the construction of baffle means for covering openings through which arcing gases are vented from the circuit breaker housing.

In the field of molded case circuit breakers the trend has been to increase current interrupting ratings for a given case size. This compact construction leads to a situation where the arcing gases generated during fault current interruption are in a relatively small housing so that pressure therein tends to build up very rapidly. To prevent this pressure from becoming excessive, it is necessary to provide vent openings in the housing.

If highly ionized gases are permitted to exit from the housing through the vent openings into the region of the panelboard bus bars, arcing will occur between external bus bars. Thus, it becomes necessary to provide baffle means over the vent openings to reduce ionization of the arcing gases. A typical prior art baffle means consists of a pair of metal screens cemented to opposite sides of an insulating frame. This construction has been found to be relatively costly because of the number of parts, the necessity of producing different types of parts, the necessity of cementing the parts together, and in some cases the necessity of cementing the baffle means to a housing part.

In accordance with the instant invention, a baffle means is constructed by stacking two identical insulating members in face-to-face relationship. Each member is constructed by a single stamping operation that cuts the element to size, cuts a locating notch, makes perforations, and offsets the four corners of the element to provide face protrusions. The elements are stacked face-to-face with the face protrusions engaging one another so that there is a slight spaced between the element faces. In addition, locating notches on the respective elements are at opposite ends of the assembly, and as a result the elements are operatively positioned so that perforations in one element are offset with respect to perforations in the other element. The baffle assembly is resiliently compressible to a slight extent so that edges of the assembly may be inserted into slots in the housing and be frictionally held therein.

According, a primary object of the instant invention is to reduce the cost and facilitate assembly of a baffle means for covering a vent opening in a circuit breaker housing.

Another object is to provide a baffle means of this type constructed solely of two identical elements.

Still another object is to provide a baffle means of this type in which each element is formed from insumating sheet material by a single stamping operation.

These objects as well as other objects of this invention shall become readily apparent after reading the following description of the accompanying drawings in which:

In FIG. 1 the circuit breaker cover has been removed so that internal elements are visible.

FIG. 3 is an end view of the circuit breaker, with its cover in place, looking in the direction of arrows 3—3 of FIG. 1.

FIG. 4 is a side view of one of the baffle assemblies.

FIG. 5 is an elevation of the baffle assembly of FIG. 4 looking in the direction of arrow 5—5.

FIG. 6 is an elevation of the baffle assembly elements looking at the faces thereof, or in the direction of arrows 6—6 of FIG. 5.

FIG. 7 is a plan view of the baffle assembly elements as they are being separated.

Figure 1:
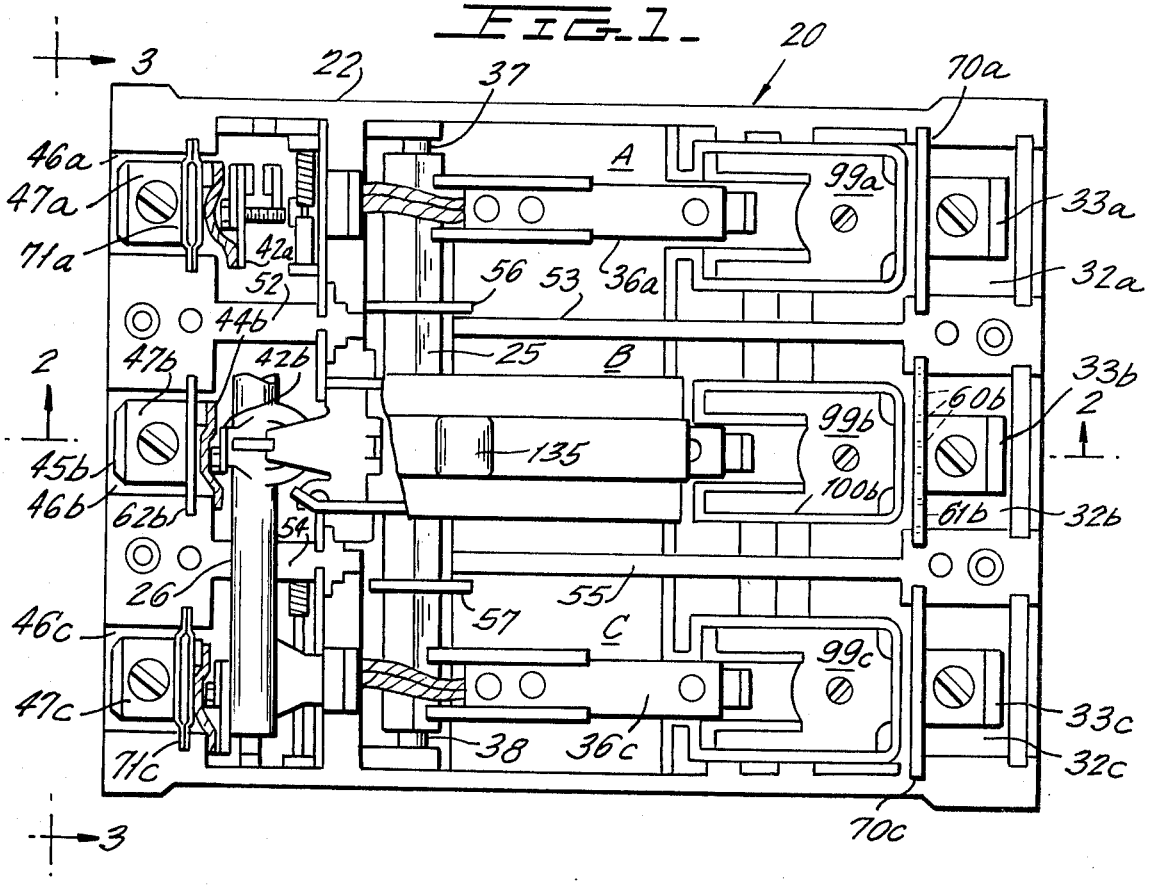
FIG. 1 is a plan view of a three-phase molded case circuit breaker including baffle means constructed in accordance with teachings of the instant invention.
Figure 2:
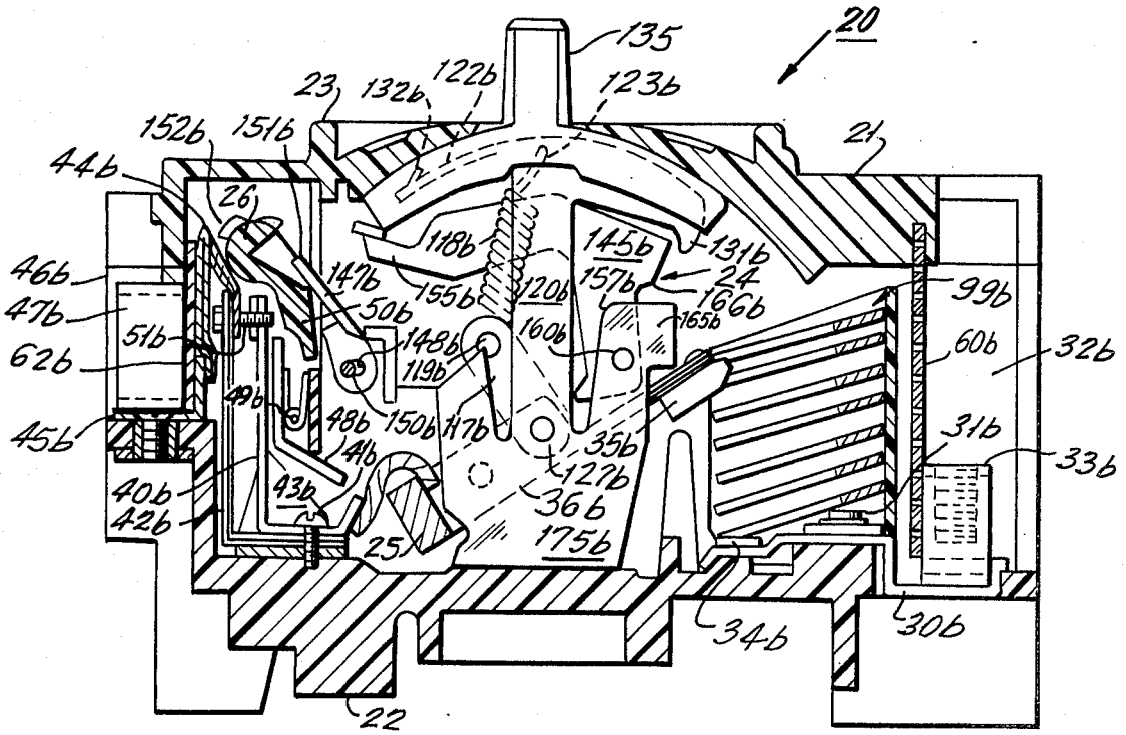
FIG. 2 is a longitudinal cross-section taken through line 2—2 of FIG. 1, looking in the direction of arrows 2—2.

Three pole circuit breaker 20 comprises a common case 21 for all three phases including molded base 22 and cooperating removable molded cover 23. Contact arm tie bar 25 and common tripper bar 26 mechanically interconnect all three phases A-C so that single operating mechanism 24 is effective to bring about simultaneous operation of all three phases A-C. Operating mechanism 24 may be of a conventional type, one of which is illustrated in the U.S. Patent to J. C. Brumfield entitled "Instantaneous Trip Circuit," and assigned to the assignee of the instant invention, U.S. Pat. No. 2,673,908.

Since the specific pole units A-C and operating mechanism 24 do not, per se, comprise this invention, the description thereof will be rather brief. Further, for the sake of brevity only the center pole unit B shall be described, it being understood that current carrying and trip unit elements of the two outside pole units A and C are of substantially identical construction.

Pole unit B comprises line strap **30*b* secured to base 22 by rivet means 31*b*. One end of strap 30*b* extends into end chamber 32*b* of case 22. Solderless line terminal connector 33*b* is secured to this end of strap 30*b* and is disposed within chamber 32*b*. Stationary contact 34*b* is secured to the other end of strap 30*b***.

Movable contact **35*b*, engageable with cooperating stationary contact 34*b*, is secured to one end of contact arm 36*b* while the other end of arm 36*b* is secured to common bar 25. Ends 37, 38 of bar 25 are mounted to pins extending inward from the side walls of base 22 to act as pivots for bar 25. Braid 39*b* extends from contact arm 36*b* to one end of bimetal protective shunt 40*b* which is secured by screw means 41*b* to base 22. Screw means 41*b* also secures one end of bimetal 42*b* and magnet 43*b* to base 22. Braid 44*b* extends from the free end of bimetal 42*b* to load terminal member 45*b* which extends into chamber 46*b* at the load end of circuit breaker 20. Solderless line terminal connector 47*b* is disposed within chamber 46*b* and is mounted upon terminal member 45*b***.

Operating mechanism 24 is described in the aforesaid U.S. Pat. No. 2,673,908 and comprises T-member **120*b* provided near the upper portion thereof with a substantially rectangular extension 131*b*. Upper T-member portion 122*b* is slotted and provided with a raised member 132*b* which serves to be engaged by plastic operating handle 135 for manually opening and closing circuit breaker 20. One leg 155*b* of V-shaped cradle 145*b* is shaped to engage latch 147*b*. Latch 147*b* is provided with a slot 148*b* engaged by pin 150*b* around which latch 147*b* can rotate and also have translational motion. Lach 147*b* is also provided with a pointed end 151*b* latched, under normal conditions, by a latch surface 152*b* on tripper bar 26**.

Latch surface **152*b* is constructed of a thin strip of material on tripper bar 26 supporting latch 147*b*. Leg 157*b* of V-shaped member 145*b* is provided with a cylindrical hole engaged by pivot pin 160b secured to the raised portion 165b of frame 175b. Leg 157b of V-shaped member 145b is provided at the bottom of the V with a shoulder extension 166b. Raised portion 165b of frame 175b is provided with an opening through which contact arm 36b extends. Operating spring 118b is secured to handle 135b at 123b and to the pin 119b at the knee of the operating toggle only one link 117b** of which is shown.

Automatic instantaneous tripping of circuit breaker 20 is effected when armature 48b is attracted by magnet 43b so as to be pivoted clockwise about pin 49b into engagement with the tripper bar extension 50b. This causes tripper bar 26 to rotate counterclockwise to free latch 147b. Automatic time delay tripping of circuit breaker 20 is effected when the free end of bimetal 42b has deflected to the right until calibrating screw 51b carried by bimetal 42b engages tripper bar extension 50b also causing a counterclockwise rotation of tripper bar 26.

Base 22 is provided with longitudinally extending partitions 52, 53 which separate phases A and B and also with longitudinally extending partitions 54, 55 which separate phases B and C. Similar internal formations of cover 23 cooperate with partitions 52–55 to effect substantial isolation of phases A-C. Circular members 56, 57 secured to common bar 25 add to the isolation.

The term "isolation" as used herein refers to the measures taken to prevent the passage within the case from pole to pole of gases produced at the cooperating contacts during circuit. The term "substantial isolation" as used herein refers to the fact that the isolation will not be complete unless elaborate measures are taken. As a practical matter it is not necessary to resort to these elaborate measures since a small leakage between phases can be tolerated.

In the center pole B the line side chamber 32b communicates with the internal portion of case 21, wherein pole B is disposed by means of the perforations 60b of sheet 61b. The other end of pole B is closed off by solid member 62b. Thus, the arcing gases formed during the parting of cooperating contacts 34b, 35b will pass between the parallel plates of arc extinguisher 99b and the open right hand end of the frame 100b, through perforations 60b comprising the venting means for phase B.

In the two outside poles A and C, the line side chambers 32a, 32c are sealed off from poles A and C by solid members 70a, 70c, respectively. However, the load side chambers 46a, 46c of poles A and C, respectively, communicate with the poles A and C by means of perforated baffle assemblies 71a, 71c, respectively. Thus, the arcing gases of the outside poles A and C will be through perforated baffle assemblies 71a, 71c at the load side of circuit breaker 20, as explained in U.S. Pat. No. 3,043,939 issued July 10, 1962, to C. E. Gryctko for "Separate Phase Directed Venting". Perforated sheet 60b, assemblies 71a and 71c, and solid members 62b, 70a, 70c each have their vertical edges disposed within vertical slots of base 22 and cover 23.

Baffle assemblies 71a, 71c are of identical construction so that only baffle assembly 71a will be described in detail, with particular reference to FIGS. 4 through 6. Assembly 71a consists solely of two identical elements 80, 81 of insulating material which may be molded or stamped in a single operation. A suitable material for stamping is black fiber. Element 80 is a rectangular sheet-like member whose face 82 is provided with protrusions 82 at all four corners thereof. In addition, element 80 is provided with a four row by five row array of perforations 84, 84, etc., as well as being provided with locating notch 85 in one edge thereof.

Elements 80, 81 are stacked so that their respective faces 82, 86 are in confronting relationship and their respective corner protrusions 83, 87 are engaged to slightly space faces 82 and 86. In addition, the respective locating notches 85, 88 of elements 80, 81 are disposed at opposite ends of assembly 71a and the respective sets of perforations 84, 89 are out of alignment with one another to provide a tortuous path for gases flowing through assembly 71a.

It is noted that the slots in cover 21 or base 22 which receive the baffle assemblies 71a, 71c are dimensioned to provide a friction-fit which is facilitated by the fact that baffle assemblies 71a, 71c are resiliently compressible.

It is also noted that for some types of circuit breakers one or more of the members 60b, 62b, 70a, and 70c may be replaced by baffle assemblies constructed in accordance with teachings of the instant invention.

Although preferred embodiments of this novel invention have been described, many variations and modifications will now be apparent to those skilled in the art, and it is therefore preferred that the instant invention be limited not by the specific disclosure herein but only by the appending claims.

The embodiments of the invention in which an exclusive privilege or property is claimed are defined as follows:

1. A circuit breaker including a housing, separable cooperating contacts disposed within said housing, said housing having an opening for venting of expanding gases developed during interruption of arcs drawn between said contacts upon separation thereof, a baffle assembly substantially closing said opening, said assembly including first and second generally platelike elements having integrally formed protrusions which maintain perforated main portions of said elements stacked in face-to-face closely spaced relationship.

2. A circuit breaker as set forth in claim 1 in which the first and second elements are identical.

3. A circuit breaker as set forth in claim 2 in which the protrusions of the first element engage the second element and protrusions of the later element engage the former element.

4. A circuit breaker as set forth in claim 2 in which the protrusions of the first element engage the protrusions of the second element.

5. A circuit breaker as set forth in claim 4 in which the protrusions are at four corners of the assembly.

6. A circuit breaker as set forth in claim 5 wherein, within said assembly, perforations of the first element are offset with respect to perforations of the second element.

7. A circuit breaker as set forth in claim 1 wherein, within said assembly, perforations of the first element are offset with respect to perforations of the second element.

8. A circuit breaker as set forth in claim 7 in which each of the elements includes an indexing mark, said marks of the respective elements being disposed at opposite ends of the assembly.

9. A circuit breaker as set forth in claim 1 in which each of the elements includes an indexing mark, said marks of the respective elements being disposed at opposite ends of the assembly.

10. A circuit breaker as set forth in claim 1 in which the elements are constructed solely of insulating material and said assembly is constructed solely of said first and second elements.

* * * * *